US010985442B2

(12) United States Patent
Ryoo et al.

(10) Patent No.: US 10,985,442 B2
(45) Date of Patent: Apr. 20, 2021

(54) ANTENNA APPARATUS, ANTENNA MODULE, AND CHIP PATCH ANTENNA OF ANTENNA APPARATUS AND ANTENNA MODULE

(71) Applicant: Samsung Electro-Mechanics Co., Ltd., Suwon-si (KR)

(72) Inventors: Jeong Ki Ryoo, Suwon-si (KR); Nam Ki Kim, Suwon-si (KR); Eun Young Jung, Suwon-si (KR); Hong In Kim, Suwon-si (KR); Ju Hyoung Park, Suwon-si (KR); Won Cheol Lee, Suwon-si (KR); Kyu Bum Han, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 97 days.

(21) Appl. No.: 16/515,464

(22) Filed: Jul. 18, 2019

(65) Prior Publication Data

US 2020/0303805 A1 Sep. 24, 2020

(30) Foreign Application Priority Data

Mar. 18, 2019 (KR) ..... 10-2019-0030581

(51) Int. Cl.
*H01Q 1/38* (2006.01)
*H01Q 1/22* (2006.01)
(Continued)

(52) U.S. Cl.
CPC ..... *H01Q 1/2283* (2013.01); *H01Q 1/38* (2013.01); *H01Q 9/0414* (2013.01); *H01Q 23/00* (2013.01)

(58) Field of Classification Search
CPC ..... H01Q 1/2283; H01Q 1/24; H01Q 1/38; H01Q 9/0414; H01Q 9/0407; H01Q 23/00; H01Q 9/065; H01L 23/12
See application file for complete search history.

(56) References Cited

U.S. PATENT DOCUMENTS 6,320,547 B1 11/2001 Fathy et al.
7,109,942 B2 9/2006 McCarville et al.
(Continued)

FOREIGN PATENT DOCUMENTS

KR 10-0917847 B1 9/2009
KR 10-2016-0132649 A 11/2016
(Continued)

OTHER PUBLICATIONS

Korean Office Action dated Nov. 11, 2019 in counterpart Korean Patent Application No. 10-2019-0030581 (6 pages in English and 6 pages in Korean).

*Primary Examiner* — Jimmy T Vu
(74) *Attorney, Agent, or Firm* — NSIP Law

(57) ABSTRACT

An antenna apparatus includes: a ground plane having a through-hole; a feed line disposed below the ground plane; an insulating layer disposed between the feed line and the ground plane; a feed via electrically connected to the feed line, and passing through the through-hole; and a chip patch antenna electrically connected to the feed via. The chip patch antenna includes: a patch antenna pattern electrically connected to the feed via; an upper coupling pattern disposed above the patch antenna pattern; edge coupling patterns surrounding a portion of the patch antenna pattern; upper edge coupling patterns surrounding a portion of the upper coupling pattern; and a dielectric layer disposed in a first region between the patch antenna pattern and the upper coupling pattern, and in a second region between the edge
(Continued)

coupling patterns and the upper edge coupling patterns, and having a dielectric constant higher than that of the insulating layer.

27 Claims, 16 Drawing Sheets

(51) Int. Cl.
*H01Q 9/04* (2006.01)
*H01Q 23/00* (2006.01)

(56) References Cited

U.S. PATENT DOCUMENTS

| | | | | |
|---|---|---|---|---|
| 9,812,786 | B2 | 11/2017 | Foo | |
| 10,103,450 | B2 | 10/2018 | Dang et al. | |
| 2016/0336646 | A1 | 11/2016 | Baek et al. | |
| 2018/0205155 | A1* | 7/2018 | Mizunuma ..... | H01Q 21/0025 |
| 2018/0337446 | A1* | 11/2018 | Nakazawa ..... | H01Q 21/0087 |

FOREIGN PATENT DOCUMENTS

| | | | |
|---|---|---|---|
| WO | WO 2008/069493 | A1 | 6/2008 |
| WO | WO 2017/047396 | A1 | 3/2017 |

* cited by examiner

ANTENNA APPARATUS, ANTENNA MODULE, AND CHIP PATCH ANTENNA OF ANTENNA APPARATUS AND ANTENNA MODULE

CROSS-REFERENCE TO RELATED APPLICATIONS

This application claims the benefit under 35 U.S.C. § 119(a) of Korean Patent Application No. 10-2019-0030581 filed on Mar. 18, 2019 in the Korean Intellectual Property Office, the entire disclosure of which is incorporated herein by reference for all purposes.

BACKGROUND

1. Field

The following description relates to an antenna apparatus, an antenna module, and a chip patch antenna disposed therein.

2. Description of Related Art

Data traffic of mobile communications is increasing rapidly every year. Technological development to support such a leap in data amounts transmitted in real-time in wireless networks is underway. For example, applications of the contents of Internet of Things (IoT) based data, live VR/AR in combination with augmented reality (AR), virtual reality (VR), and social networking services (SNS), autonomous navigation, a synch view for real-time image transmission from a user's viewpoint using a subminiature camera, and the like, require communications for supporting the exchange of large amounts of data, for example, 5th generation (5G) communications, mmWave communications, or the like.

Thus, millimeter wave (mmWave) communications including 5G communications have been researched, and research into the commercialization/standardization of antenna apparatuses to smoothly implement such millimeter wave (mmWave) communications has been undertaken.

Radio frequency (RF) signals in high frequency bands of, for example, 24 GHz, 28 GHz, 36 GHz, 39 GHz, 60 GHz and the like, are easily absorbed in the course of transmission and lead to loss. Thus, the quality of communications may decrease dramatically. Therefore, antennas for communications in high-frequency bands require an approach different from the antenna technology of the related art, and may require a special technological development, such as for a separate power amplifier, for securing an antenna gain, integration of an antenna and a radio frequency integrated circuit (RFIC), and effective isotropic radiated power (EIRP), or the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a ground plane having a through-hole; a feed line disposed below the ground plane; an insulating layer disposed between the feed line and the ground plane; a feed via having a first end electrically connected to the feed line, and passing through the through-hole; and a chip patch antenna electrically connected to a second end of the feed via. The chip patch antenna includes: a patch antenna pattern electrically connected to the feed via; an upper coupling pattern disposed above the patch antenna pattern; edge coupling patterns surrounding a portion of the patch antenna pattern; upper edge coupling patterns surrounding a portion of the upper coupling pattern; and a dielectric layer disposed in a first region between the patch antenna pattern and the upper coupling pattern, and in a second region between the edge coupling patterns and the upper edge coupling patterns, and having a dielectric constant higher than a dielectric constant of the insulating layer.

The antenna apparatus may further include an electrical connection structure electrically connected to the feed via in series on the ground plane, and having a melting point lower than a melting point of the feed via.

A portion of the dielectric layer corresponding to the first region and a portion of the dielectric layer corresponding to the second region may be integrated with each other. The dielectric layer may have a thickness corresponding to a distance between the patch antenna pattern and the upper coupling pattern.

The patch antenna pattern, the upper coupling pattern, the edge coupling patterns, and the upper edge coupling patterns may be separated from each other.

The patch antenna pattern and the edge coupling patterns may be disposed on a same layer. The upper coupling pattern and the upper edge coupling patterns may be disposed on another same layer.

Each of the edge coupling patterns may be smaller than the patch antenna pattern. Each of the edge coupling patterns may be smaller than the upper coupling pattern.

A distance between adjacent edge coupling patterns, among the edge coupling patterns, may be less than a distance between each of the edge coupling patterns and the patch antenna pattern. A distance between adjacent upper edge coupling patterns, among the upper edge coupling patterns, may be less than a distance between each of the upper edge coupling patterns and the upper coupling pattern.

The edge coupling patterns may be arranged to form a polygon. An outer boundary of an edge coupling pattern, among the edge coupling patterns, closest to a vertex of the polygon may include a groove.

Portions of the patch antenna pattern on two sides of a point of the patch antenna pattern at which the feed via is connected to the feed via may be recessed. A width of each of the recessed portions of the patch antenna pattern may be greater than a distance between the recessed portions of the patch antenna pattern.

A thickness of the dielectric layer may be greater than a thickness of the insulating layer.

The dielectric layer may be disposed to isolate the patch antenna pattern from the upper coupling pattern and to isolate the edge coupling patterns from the upper edge coupling patterns.

An area between the edge coupling patterns and the ground plane may be formed of a non-conductive material or air.

The antenna apparatus may further include an encapsulant disposed on an upper side of the upper edge coupling patterns and an upper side of the upper coupling pattern. An area between the upper edge coupling patterns and the encapsulant, and an area between the upper coupling pattern and the encapsulant may not include a conductive layer.

In another general aspect, An antenna module includes: a ground plane having through-holes; feed lines disposed below the ground plane; an insulating layer disposed between the feed lines and the ground plane; feed vias each having a first end electrically connected to a corresponding feed line among the feed lines, and passing through a corresponding through-hole among the through-holes; and chip patch antennas electrically connected, respectively, to second ends of corresponding feed vias among the feed vias. At least one chip patch antenna among the chip patch antennas includes a patch antenna pattern electrically connected to a corresponding feed via among the corresponding feed vias; an upper coupling pattern disposed above the patch antenna pattern; edge coupling patterns surrounding the patch antenna pattern; upper edge coupling patterns surrounding the upper coupling pattern; and a dielectric layer disposed in a first region between the patch antenna pattern and the upper coupling pattern, and in a second region between the edge coupling patterns and the upper edge coupling patterns, and having a dielectric constant higher than a dielectric constant of the insulating layer.

The dielectric layer may be disposed to isolate the patch antenna pattern from the upper coupling pattern and to isolate the edge coupling patterns from the upper edge coupling patterns.

The antenna module may further include electrical connection structures electrically connected, respectively, to the feed vias on the ground plane, and having a melting point lower than a melting point of the feed vias.

The antenna module may further include: an integrated circuit (IC) disposed below the feed lines; wiring vias electrically connecting the feed lines and the IC to each other, respectively; and a core member isolated from the feed lines and including a core via electrically connected to the IC, and surrounding the IC.

In another general aspect, a chip patch antenna includes: a feed port; a second dielectric layer disposed on the feed port; a feed via penetrating through the second dielectric layer and having a first end electrically connected to the feed port; a patch antenna pattern disposed on the second dielectric layer and electrically connected to a second end of the feed via; an upper coupling pattern disposed above the patch antenna pattern; edge coupling patterns surrounding at least a portion of the patch antenna pattern; upper edge coupling patterns surrounding at least a portion of the upper coupling pattern; and a first dielectric layer disposed in a first region between the patch antenna pattern and the upper coupling pattern and in a second region between the edge coupling patterns and the plurality of upper edge coupling patterns, and having a dielectric constant equal to or greater than 5.

The dielectric constant of the first dielectric layer may be greater than a dielectric constant of the second dielectric layer.

The patch antenna pattern, the upper coupling pattern, the edge coupling patterns, and the upper edge coupling patterns may be separated from each other.

Each of the edge coupling patterns may be smaller than the patch antenna pattern. Each of the upper edge coupling patterns may be smaller than the upper coupling pattern. A distance between adjacent edge coupling patterns, among the edge coupling patterns, may be less than a distance between each of the edge coupling patterns and the patch antenna pattern. A distance between adjacent edge coupling patterns, among the upper edge coupling patterns, may be less than a distance between each of the upper edge coupling patterns and the upper coupling pattern. Portions of the patch antenna pattern on two sides of a point of the patch antenna pattern at which the feed via is connected to the feed via may be recessed. A width of each of the recessed portions of the patch antenna pattern may be greater than a distance between the recessed portions of the patch antenna pattern.

The edge coupling patterns may be arranged to form a polygon. An outer boundary of an edge coupling pattern, among the edge coupling patterns, closest to a vertex of the polygon may include a groove.

The edge coupling patterns may be disposed around the coupling pattern in a polygonal path. A groove may be formed in a corner region of an edge coupling pattern, among the edge coupling patterns, closest to a vertex of the polygonal shape.

The upper edge coupling patterns may be disposed around the upper coupling pattern in a circular path.

The upper coupling pattern may have a circular shape.

The patch antenna pattern and the edge coupling patterns may be disposed at a first vertical position, and the upper coupling pattern and the upper edge coupling patterns may be disposed at a second vertical position above the first vertical position.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
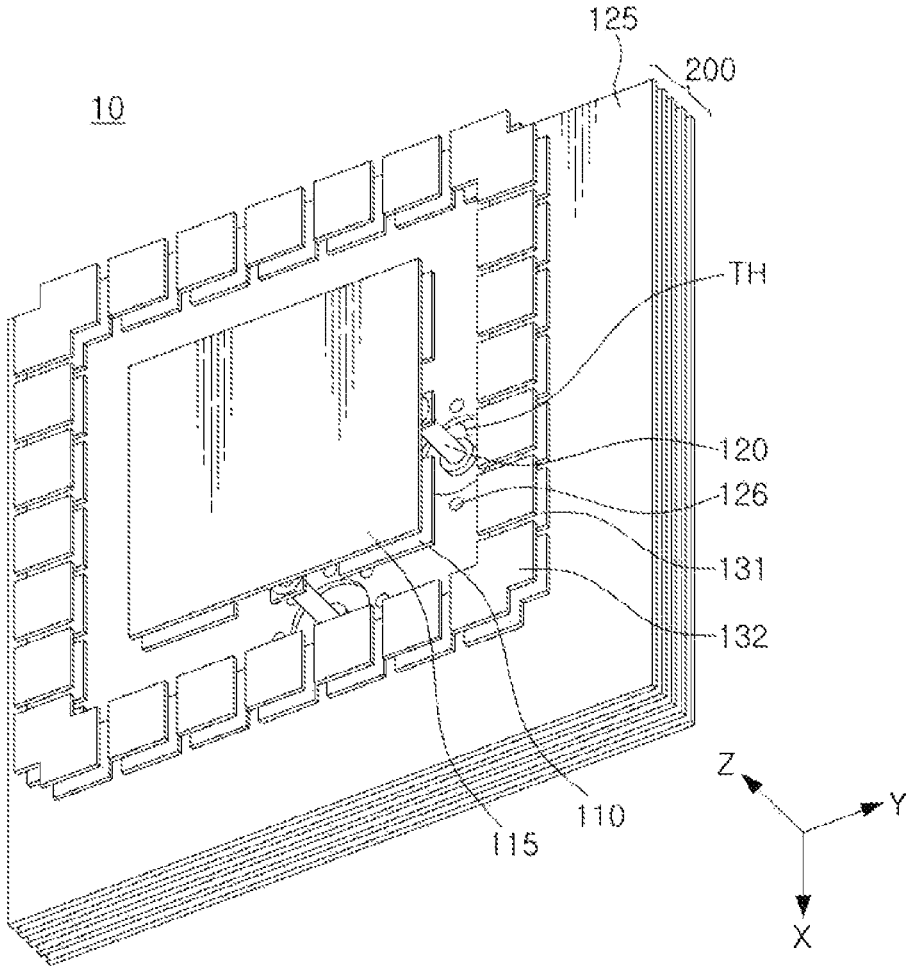
FIG. 1 is a perspective view of an antenna apparatus, according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 2A:
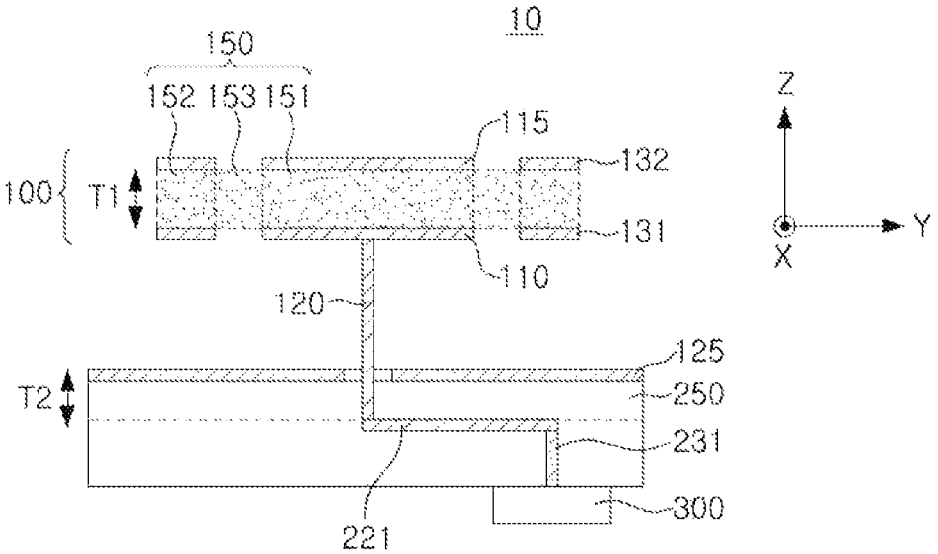
FIG. 2A is a side view illustrating the antenna apparatus of FIG. 1, according to an example.

FIG. 1 is a perspective view of an antenna apparatus 10, according to an example. FIG. 2A is a side view illustrating the antenna apparatus 10, according to an example.

Referring to FIGS. 1 and 2A, the antenna apparatus 10 includes a ground plane 125, a feed line 221, an insulating layer 250, a feed via 120, and a chip patch antenna 100.

The ground plane 125 has a through-hole TH. The ground plane 125 may provide a boundary condition to the chip patch antenna 100, and thus, may reflect a radio frequency (RF) signal radiated from the chip patch antenna 100. Thus, since a radiation pattern of the chip patch antenna 100 may be relatively more concentrated in a Z direction, gain and/or directivity of the chip patch antenna 100 may be improved.

In addition, since the ground plane 125 may substantially block a gap between the chip patch antenna 100 and the feed line 221, electromagnetic isolation between the chip patch antenna 100 and the feed line 221 may be improved. Accordingly, noise introduced during an RF signal transmission process between the chip patch antenna 100 and an integrated circuit (IC) 300 may be reduced.

The feed line 221 is disposed below the ground plane 125, for example, in the Z direction. A radio frequency (RF) signal may flow in a horizontal direction, for example, an X direction and/or a Y direction, through the feed line 221. Therefore, a plurality of chip patch antennas 100 may be efficiently arranged above the ground plane 125. One end of the feed line 221 may be electrically connected to a wiring via 231.

The feed via 120 is disposed such that one end thereof is electrically connected to the feed line 221 and penetrates through the through-hole TH. The RF signal may flow in the Z direction through the feed via 120. For example, the feed via 120 may be formed in an integrated manner as in the case of a through via, or may be implemented as a plurality of vias connected to each other in series.

The insulating layer 250 is disposed between the feed line 221 and the ground plane 125 and isolates the feed line 221 from the ground plane 125. As a thickness T2 of the insulating layer 250 is reduced, an overall thickness of a connection member 200 and energy loss of the RF signal flowing between the chip patch antenna 100 and the IC 300 may be reduced. For example, the insulating layer 250 may be formed of an insulating material having relatively low dielectric loss (Df), thereby reducing energy loss of the RF signal passing through the feed line 221.

As such, the design of the insulating layer 250 may be more focused on the size and energy efficiency in terms of the electrical connection between the chip patch antenna 100 and the IC 300.

As the antenna apparatus 10 and an antenna module including the antenna apparatus 10 include the chip patch antenna 100 designed to be relatively more focused on the antenna performance, for example, a bandwidth, a gain, directivity, the size, and the like, the overall antenna performance may be improved without substantial degradation of size and energy efficiency in terms of electrical connection.

Referring to FIGS. 1 and 2A, the chip patch antenna 100 includes a patch antenna pattern 110, an upper coupling pattern 115, edge coupling patterns 131, a upper edge coupling patterns 132, and a dielectric layer 150.

The patch antenna pattern 110 is electrically connected to the feed via 120. The patch antenna pattern 110 may receive the RF signal from the feed via 120, and may transmit the received RF signal in the Z direction, and may transfer the RF signal received in the Z direction to the feed via 120. The patch antenna pattern 110 may have an intrinsic resonant frequency of, for example, 28 GHz or 39 GHz, depending on intrinsic elements such as a shape, a size, a height and a dielectric constant of the insulating layer, or the like.

For example, the patch antenna pattern 110 is connected to a plurality of the feed vias 120, and thus, may transmit and receive a horizontal pole (H-pole) RF signal and a vertical pole (V-pole) RF signal, which are polarized waves. The H-pole RF signal may flow through a portion of the feed vias 120, and the V-pole RF signal may flow through the rest of the feed vias 120.

The upper coupling pattern 115 is disposed above the patch antenna pattern 110, for example, in the +Z direction. According to electromagnetic coupling of the upper coupling pattern 115 and the patch antenna pattern 110, the chip patch antenna 100 may have an additional resonant frequency adjacent to the intrinsic resonant frequency, and thus may have a relatively wider bandwidth than a configuration in which the upper coupling pattern 115 is not provided.

An optimal feeding point (for example, on an impedance matching reference) of the feed vias 120 in the patch antenna pattern 110 may be adjacent to an edge of the patch antenna pattern 110 depending on electromagnetic coupling of the upper coupling pattern 115. For example, when the plurality of feed vias 120 are disposed adjacent to different sides of the patch antenna pattern 110, a surface current corresponding to the H-pole RF signal and a surface current corresponding to the V-pole RF signal flow perpendicularly to each other to easily flow in the patch antenna pattern 110. Thus, the upper coupling pattern 115 may provide an environment advantageous for the implementation of polarization of the chip patch antenna 100.

The edge coupling patterns 131 are arranged to surround at least a portion of the patch antenna pattern 110, and may be electromagnetically coupled to the patch antenna pattern 110. Thus, the bandwidth of the chip patch antenna 100 may further be widened relative to a configuration in which the edge coupling patterns 131 are not provided.

The upper edge coupling patterns 132 are arranged to surround at least a portion of the upper coupling pattern 115, and thus, may be electromagnetically coupled to the upper coupling pattern 115. The upper edge coupling patterns 132 may also be electromagnetically coupled to the edge coupling patterns 131.

Accordingly, since the patch antenna pattern 110, the upper coupling pattern 115, the edge coupling patterns 131 and the upper edge coupling patterns 132 may be coupled to each other in a balanced manner, the bandwidth of the chip patch antenna 100 may be greatly increased as compared with the size of the chip patch antenna 100.

Further, when an optimal feeding point of the feed vias 120 in the patch antenna pattern 110 is close to an edge of the patch antenna pattern 110 in a first direction of the patch antenna pattern 110, for example, a 0 degree direction, the surface current flowing through the patch antenna pattern 110 may flow in a third direction, for example, a 180 degree direction, of the patch antenna pattern 110, depending on RF signal transmission/reception of the patch antenna pattern 110. In this case, the surface current may be dispersed in a second direction, for example, a 90 degree direction, and in a fourth direction, for example, a 270 degree direction. In this case, as the surface current is dispersed in the second and fourth directions, the edge coupling patterns 131 and the upper edge coupling patterns 132 may guide the RF signal leaking laterally to an upper surface in an upper side direction. Thus, since a radiation pattern of the patch antenna pattern 110 may be relatively more concentrated in the upper surface direction, the antenna performance of the patch antenna pattern 110 may be improved.

For example, the edge coupling patterns 131 may be repeatedly arranged with the same shape, and the upper edge coupling patterns 132 may be repeatedly arranged with the same shape. Accordingly, the edge coupling patterns 131 and the upper edge coupling patterns 132 may have electromagnetic bandgap characteristics, and may have a negative refractive index with respect to an RF signal in a specific frequency band. Thus, the edge coupling patterns 131 and the upper edge coupling patterns 132 may further guide a path of the RF signal of the patch antenna pattern 110 in the Z direction.

On the other hand, the edge coupling patterns 131 and the upper edge coupling patterns 132 are respectively separated from the ground plane 125, and thus, may have more adaptive characteristics with respect to the RF signal having a frequency adjacent to the frequency band of the patch antenna pattern 110, thereby further widening a bandwidth.

The dielectric layer 150 includes a first region 151 between the patch antenna pattern 110 and the upper coupling pattern 115 and a second region 152 between the edge coupling patterns 131 and the upper edge coupling patterns 132, and may have a dielectric constant (Dk) higher than a dielectric constant (Dk) of the insulating layer 250.

For example, the insulating layer 250 may include a material having a dielectric constant (Dk) of less than 5, such as a prepreg, FR-4 and/or a copper clad laminate (CCL), while the dielectric layer 150 may include a ceramic material such as low temperature co-fired ceramic (LTCC) or a material having a dielectric constant (Dk) of equal to or greater than 5, such as glass.

An effective wavelength of the RF signal in the chip patch antenna 100 may be reduced depending on a relatively high dielectric constant Dk of the dielectric layer 150. Since the overall size of the chip patch antenna 100 has a relatively high correlation with the effective wavelength length of the RF signal, the chip patch antenna 100 includes the dielectric layer 150 of high dielectric constant (Dk), and thus, may have a reduced size without substantial deterioration in antenna performance.

The chip of the chip patch antenna 100 indicates that an overall size of the chip patch antenna 100 is reduced depending on the high dielectric constant Dk of the dielectric layer 150.

The overall size of the chip patch antenna 100 may correspond to the number of the array of chip patch antennas 100 per unit size of the ground plane 125. The gain and/or directivity of the antenna apparatus 10 and an antenna module including the antenna apparatus 10 may be improved as the number of arrayed chip patch antennas 100 per unit size is increased.

Therefore, the antenna apparatus 10 and an antenna module including the antenna apparatus 10 may improve the gain and/or the directivity as the overall size of the chip patch antenna 100 is reduced.

As a result, the chip patch antenna 100 may have an improved bandwidth as compared to the size, based on a coupling structure of the patch antenna pattern 110, the upper coupling pattern 115, the edge coupling patterns 131, and the upper edge coupling patterns 132, and may secure, in a balanced manner, overall advantages related to the gain, the directivity, and/or the size depending on the high dielectric constant (Dk) of the dielectric layer 150 combined with the coupling structure.

For example, the chip patch antenna 100 may be designed to employ a single dielectric layer 150 and two conductive layers to have a substantially reduced thickness, and to have a bandwidth of 3 GHz or higher, for example, a frequency in which a return S parameter is −10 dB or less, in a frequency band of 28 GHz and/or 39 GHz.

A portion corresponding to the first region 151 and a portion corresponding to the second region 152, in the dielectric layer 150, may be integrated with each other. For example, the dielectric layer 150 may include a third region 153 between the first region 151 and the second region 152. For example, presence or non-presence of integration may be confirmed through a scanning electron microscope (SEM).

In addition, a thickness T1 of the dielectric layer 150 may be the same as a distance between the patch antenna pattern 110 and the upper coupling pattern 115. Accordingly, in the case of the coupling structure of the patch antenna pattern 110, the upper coupling pattern 115, the edge coupling patterns 131, and the upper edge coupling patterns 132, a high dielectric constant Dk of the dielectric layer 150 may be utilized more efficiently, and thus, an increase in the bandwidth of the antenna apparatus 10 and the antenna module, as compared with the size, may be facilitated.

The patch antenna pattern 110, the upper coupling pattern 115, the edge coupling patterns 131, and the upper edge coupling patterns 132 may be separated from each other.

Thus, since equivalent capacitance and equivalent inductance of the chip patch antenna 100 may be distributed in a balanced manner, a plurality of resonance frequencies of the chip patch antenna 100 may be efficiently designed, and the bandwidth of the chip patch antenna 100 may be increased more easily.

A thickness of the dielectric layer 150 may be greater than a thickness of the insulating layer 250, and the dielectric layer 150 may be disposed to provide isolation between the patch antenna pattern 110 and the upper coupling pattern 115, and between the edge coupling patterns 131 and the upper edge coupling patterns 132.

Accordingly, the high dielectric constant Dk of the dielectric layer 150 may be more easily implemented, and implementation costs and a defect rate of the chip patch antenna 100 may be reduced. For example, glass or a ceramic series material such as LTCC, having a high dielectric constant (Dk), may be relatively difficult to be implemented in a laminated structure as compared to the case of an insulating layer of a printed circuit board (PCB), or may be relatively difficult to be implemented to provide a great amount of strength as compared to the layer thickness. However, in the case of the chip patch antenna 100, a dielectric material having a high dielectric constant (Dk) may be more easily included therein by using the dielectric layer 150 having a relatively great thickness to reduce the number of layers in the laminated structure.

Figure 2B:
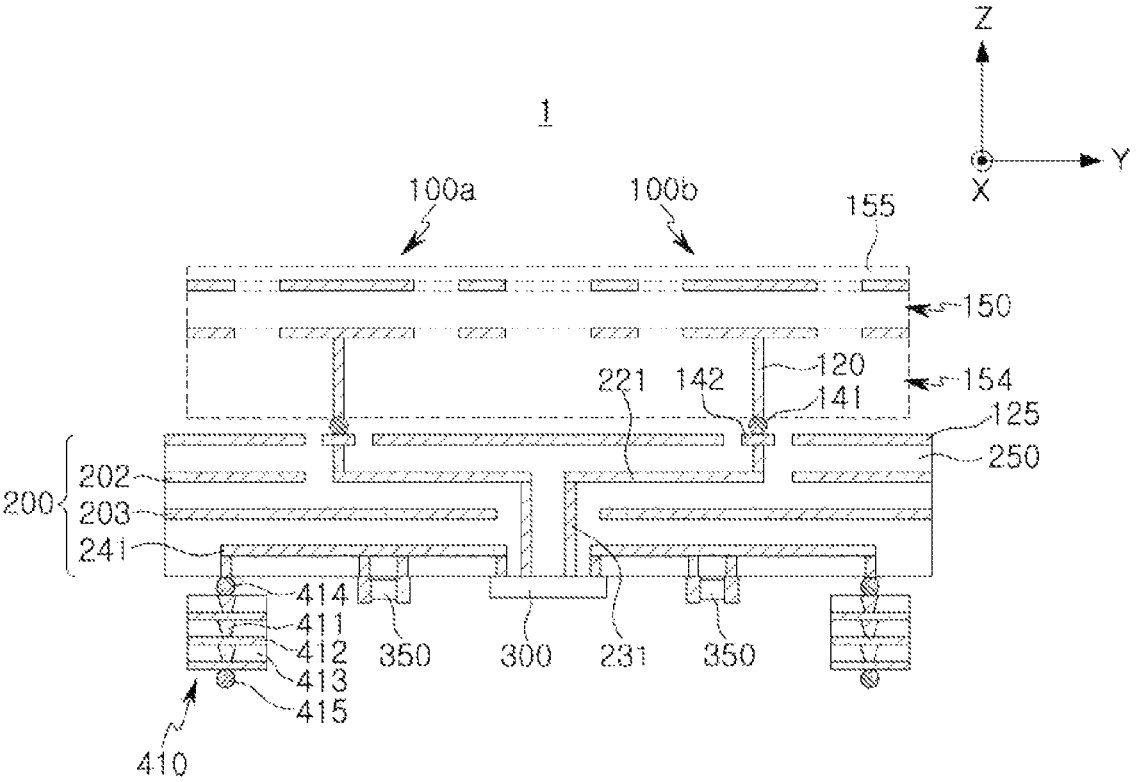
FIG. 2B is a side view of an antenna module including antenna apparatuses, according to an example.

FIG. 2B is a side view of an antenna module 1 including antenna apparatuses, according to an example.

Referring to FIG. 2B, the antenna module 1 may include antenna apparatuses including chip patch antennas 100*a* and 100*b*.

For example, the chip patch antennas 100*a* and 100*b* may be implemented together, or may be separately implemented with respect to a connection member 200.

In this case, the plurality of chip patch antennas 100*a* and 100*b* are disposed above a ground plane 125, to be electrically connected feed vias 120, and may be electrically coupled to the connection member 200 through connection structures 141 having a melting point lower than a melting point of the feed vias 120.

Accordingly, a high dielectric constant Dk of a dielectric layer 150 of the chip patch antennas 100*a* and 100*b* may be more easily implemented.

For example, the electrical connection structures 141 may be collectively disposed together on feed via connection points 142 previously provided in the connection member 200, and may be implemented using a solder including a Sn—Cu—Ag alloy paste.

The chip patch antennas 100*a* and 100*b* may further include an encapsulant 155 disposed on an upper side of upper edge coupling patterns and on an upper side of an upper coupling pattern.

In this case, a region between the plurality of upper edge coupling patterns and the encapsulant 155 and a region between the upper coupling pattern and the encapsulant 155 may not include a conductive layer. Thus, since the total number of conductive layers of the chip patch antennas 100*a* and 100*b* may be reduced, the chip patch antennas 100*a* and 100*b* may have a relatively reduced thickness, and improved antenna performance may also be exhibited.

Referring to FIG. 2B, the connection member 200 includes an insulating layer 250, a feed line 221, a wiring via 231, a wiring ground plane 202, a second ground plane 203, and a base signal line 241.

The wiring ground plane 202 may be disposed to surround the feed line 221 in a horizontal direction, for example, an X direction and/or a Y direction, thereby improving electromagnetic isolation of the feed line 221 and reducing noise of an RF signal.

The second ground plane 203 may improve electromagnetic isolation between the feed line 221 and an IC 300 and reduce noise of the RF signal.

The base signal line 241 may provide a transmission path of an intermediate frequency (IF) signal or a baseband signal. The IF signal or the baseband signal is the base signal of the RF signal and is an analog signal transmitted between the IC 300 and a communications modem.

A core member 410 may be disposed below the connection member 200 and may include a core via 411, a core wiring layer 412, and a core insulation layer 413, and may be implemented through a fan-out panel level package (FOPLP) method, but the core member 410 is not limited to this example. The core via 411 may be electrically connected to the base signal line 241 and may provide a transmission path for the IF signal or the baseband signal.

The core member 410 may be mounted on the connection member 200 through a first core electrical connection structure 414, and may be mounted on a set substrate through a second core electrical connection structure 415.

The core member 410 may have a structure surrounding a cavity, and the cavity may be used as a space in which the IC 300 and a passive component 350 are disposed.

Figure 2C:
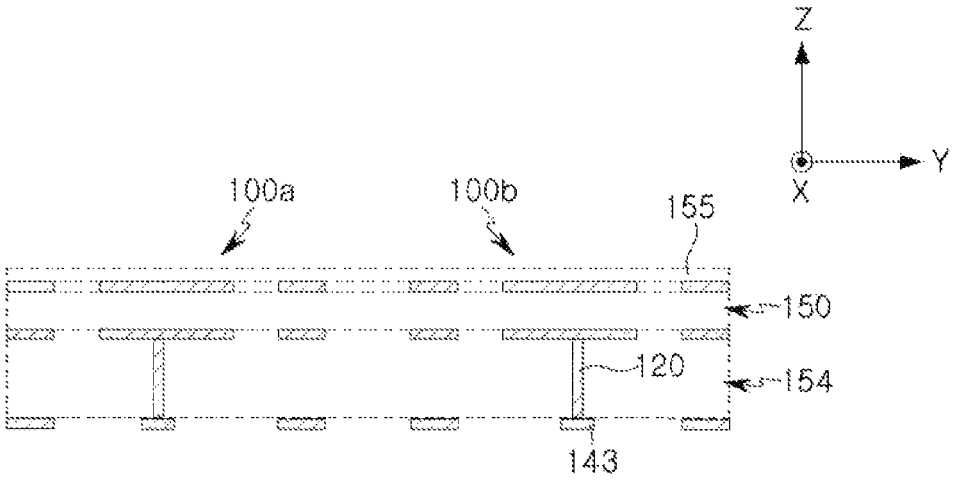
FIG. 2C is a side view of chip patch antennas, according to an example.

FIG. 2C is a side view of the chip patch antennas 100*a* and 100*b*, according to an example.

Referring to FIG. 2C, the chip patch antennas 100*a* and 100*b* may be manufactured separately from a connection member (e.g., the connection member 200). Accordingly, the dielectric layer 150 having a high dielectric constant (Dk) of 5 or more may be more efficiently disposed on the chip patch antennas 100*a* and 100*b* without considering compatibility with an insulating layer of the connection member 200.

In addition, the chip patch antennas 100*a* and 100*b* may further include a second dielectric layer 154 disposed below the dielectric layer 150.

For example, the second dielectric layer 154 may be formed of the same material as that of the dielectric layer 150 to have a relatively high dielectric constant Dk as compared to that of the insulating layer 250. As a result, an effective wavelength of the RF signal in the chip patch antennas 100*a* and 100*b* may be reduced, and thus, miniaturization of the chip patch antennas 100*a* and 100*b* may be more facilitated.

For example, the second dielectric layer 154 may be configured to have a dielectric constant lower than that of the dielectric layer 150. Thus, a boundary condition between an interface between the second dielectric layer 154 and the dielectric layer 150 and the combination of the edge coupling patterns 131 and the upper edge coupling patterns 132 allows the RF signal to be further concentrated in a vertical direction, for example, in a Z direction.

The chip patch antennas 100*a* and 100*b* may include a feed port 143 disposed below the second dielectric layer 154 to be electrically connected to the connection member 200.

The second dielectric layer 154 may provide a surface for stable placement of the feed port 143. The feed port 143 may have a shape similar to an electrode pad to have a horizontal area greater than that of the feed via 120, but the shape of the feed port 143 is not limited to this example.

For example, a solder such as a Sn—Cu—Ag alloy paste is provided to the feed port 143 in a state in which the chip patch antennas 100*a* and 100*b* are disposed on the connection member 200, and may couple the feed port 143 to the connection member 200 through reflow.

Figure 3A:
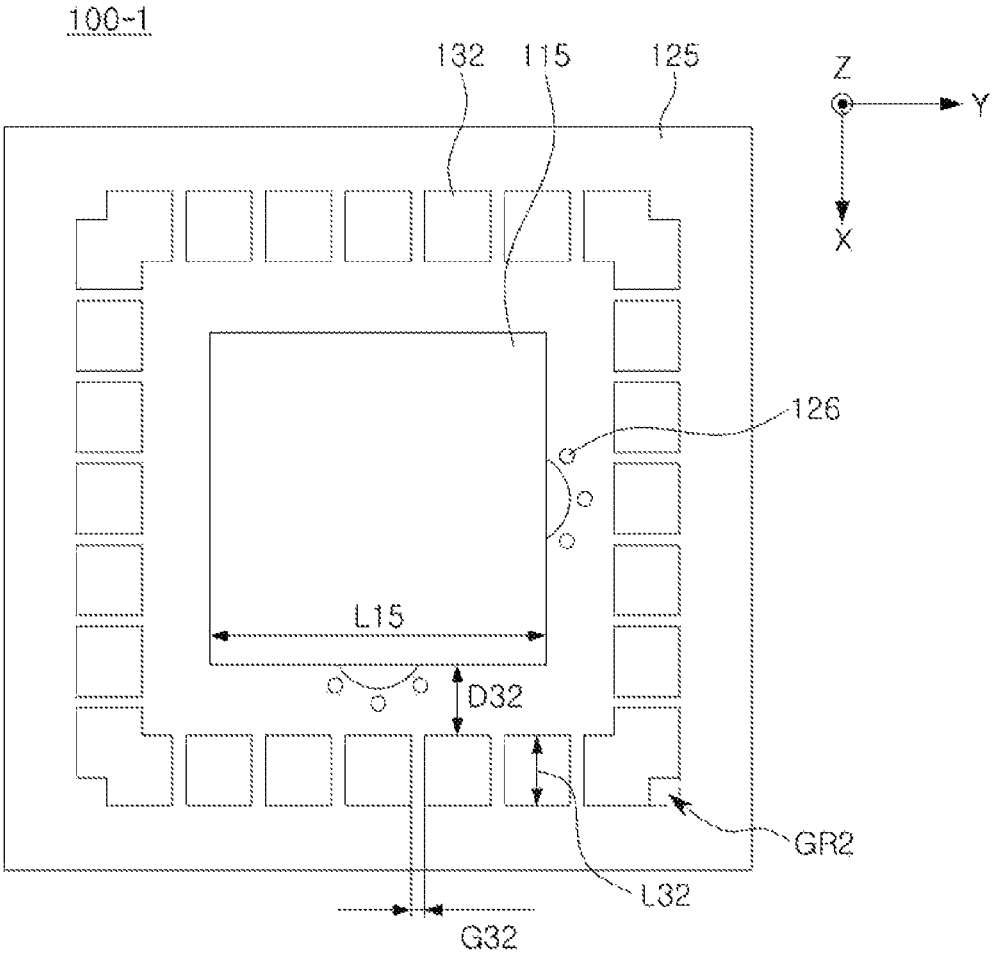
FIG. 3A is a plan view illustrating a first layer of a chip patch antenna of an antenna apparatus, according to an example.

FIG. 3A is a plan view illustrating a first layer of a chip patch antenna 100-1 of an antenna apparatus, according to an example.

Referring to FIG. 3A, the upper coupling pattern 115 and the edge coupling patterns 132 may be disposed in a single first layer.

For example, a size (e.g., length or width) L32 of each of the upper edge coupling patterns 132 is smaller than a size (e.g., length or width) L15 of the upper coupling pattern 115, and a distance G32 between adjacent upper edge coupling patterns 132 may be less than a distance D32 between the upper coupling pattern 115 and each of the upper edge coupling patterns 132. Accordingly, the upper edge coupling patterns 132 may more easily have electromagnetic bandgap characteristics having a negative refractive index with respect to a frequency of an RF signal, and the bandwidth of the chip patch antenna 100-1 may be relatively widened.

Figure 3B:
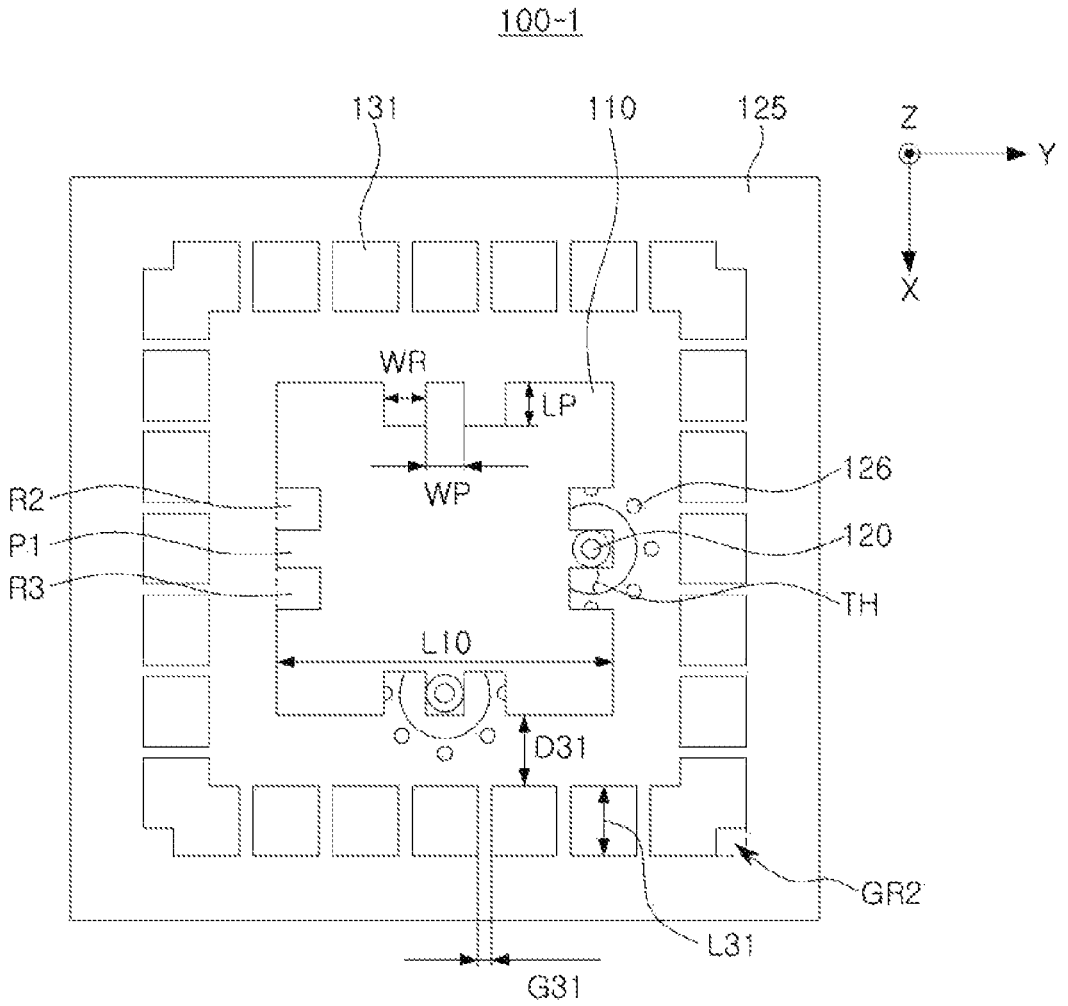
FIG. 3B is a plan view illustrating a second layer of the chip patch antenna of FIG. 3A, according to an example.

FIG. 3B is a plan view illustrating a second layer of the chip patch antenna 100-1, according to an example.

Referring to FIG. 3B, the patch antenna pattern 110 and the edge coupling patterns 131 may be disposed on a single second layer.

For example, a size (e.g., length or width) L31 of each of the plurality of edge coupling patterns 131 may be smaller than a size (e.g., length or width) L10 of the patch antenna pattern 110, and a distance G31 between adjacent edge coupling patterns 131 may be less than a distance D31 between the patch antenna pattern 110 and each of the edge coupling patterns 131. Thus, the edge coupling patterns 131 may more easily have electromagnetic bandgap characteristics having a negative refractive index with respect to a frequency of an RF signal, and the bandwidth of the chip patch antenna 100-1 may be widened.

When the plurality of edge coupling patterns 131 are arranged to have a polygonal shape, an outer boundary of an edge coupling pattern 131 nearest to the vertex of the polygon may have a groove GR2. That is the groove GR2 may be formed in a corner region of the edge coupling pattern 131 nearest to the vertex of the polygon. The edge coupling patterns 131 including the groove GR2 may have a structure more suitable for the high dielectric constant Dk of the dielectric layer.

Two side portions R2 and R3 of points P1 at which the feed vias 120 are connected in the patch antenna pattern 110 are recessed, and a width WR of each of the recessed portions R2 and R3 in the patch antenna pattern 110 may be greater than a distance WP between the recessed portions R2 and R3 in the patch antenna pattern 110. Accordingly, the patch antenna pattern 110 has a structure more suitable for the high dielectric constant Dk of the dielectric layer, and thus may have a wider bandwidth, relative to conventional patch antenna patterns.

Figure 3C:
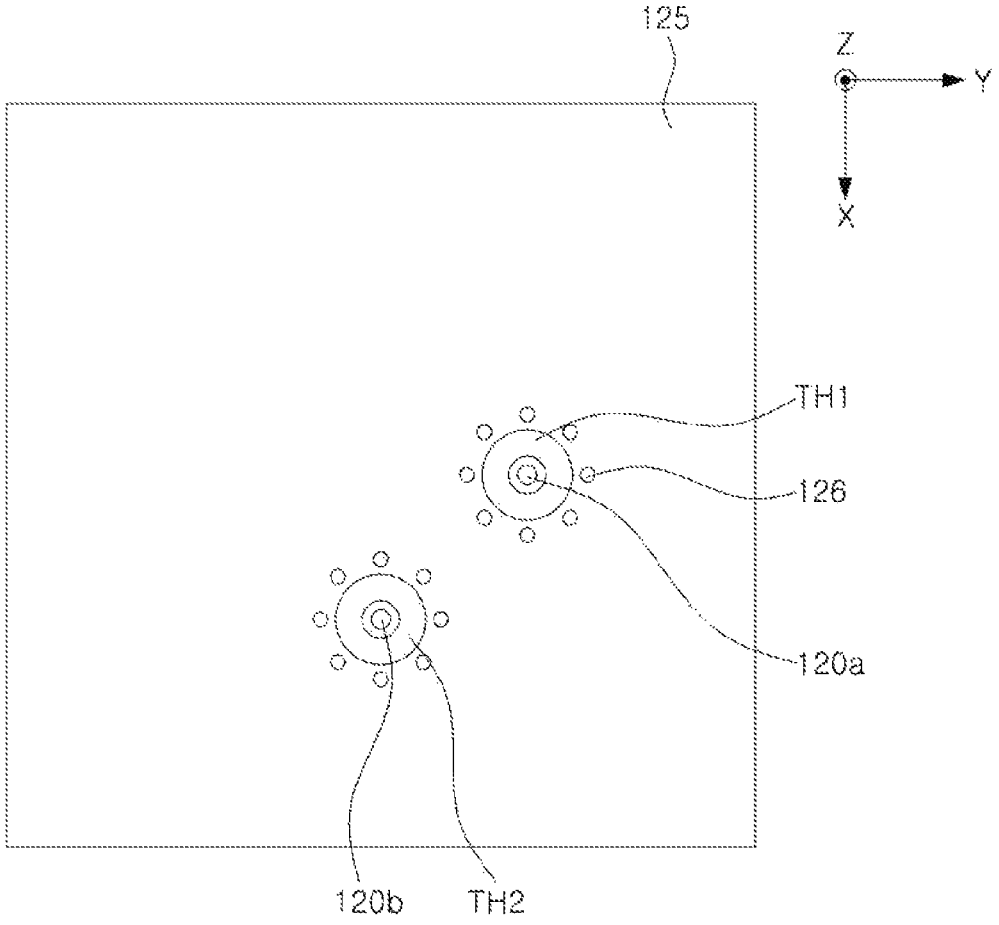
FIG. 3C is a plan view of a ground plane of an antenna apparatus, according to an example.

FIG. 3C is a plan view of the ground plane 125 of an antenna apparatus, according to an example.

Referring to FIG. 3C, the ground plane 125 may have through-holes TH1 and TH2 through which feed vias 120*a* and 120*b* pass, respectively. One of the feed vias 120*a* and 120*b* may provide a transmission path of an H-pole RF signal, and the other of the feed vias 120*a* and 120*b* may provide a transmission path of a V-pole RF signal.

In this case, the ground plane 125 does not include an electrical connection path for the edge coupling patterns 131. For example, an area between the edge coupling patterns 131 and the ground plane 125 may be formed of a nonconductive material or air. Accordingly, the bandwidth of the antenna apparatus and the antenna module may be further improved.

Figure 3D:
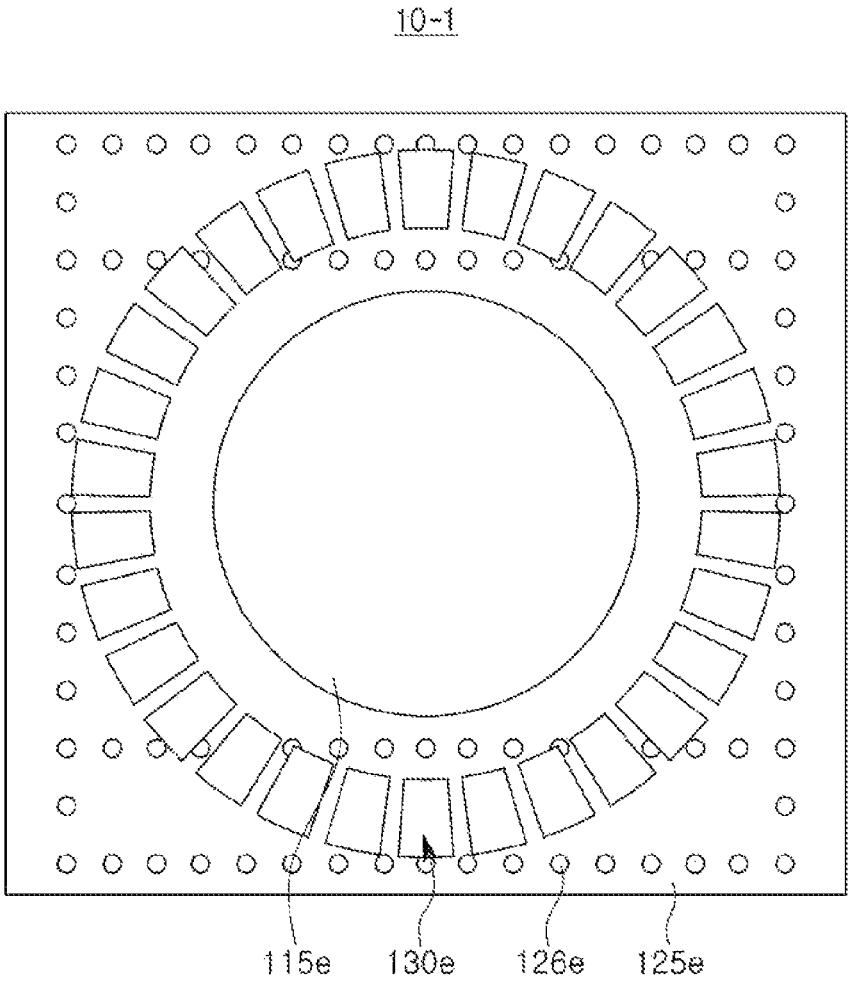
FIG. 3D is a plan view illustrating a form of an antenna apparatus, according to an example.

FIG. 3D is a plan view illustrating a form of an antenna apparatus 10-1, according to an example.

Referring to FIG. 3D, an upper coupling pattern 115*e* may be circular, and upper edge coupling patterns 130*e* may be arranged to in a circular pattern around the coupling pattern 115*e*. First shielding vias 126*e* included in a ground plane 125*e* may be arranged differently from the arrangement of the upper edge coupling patterns 130*e*. For example, the shape of respective components of an antenna apparatus and an antenna module is not limited to a quadrangular shape.

Figure 4A:
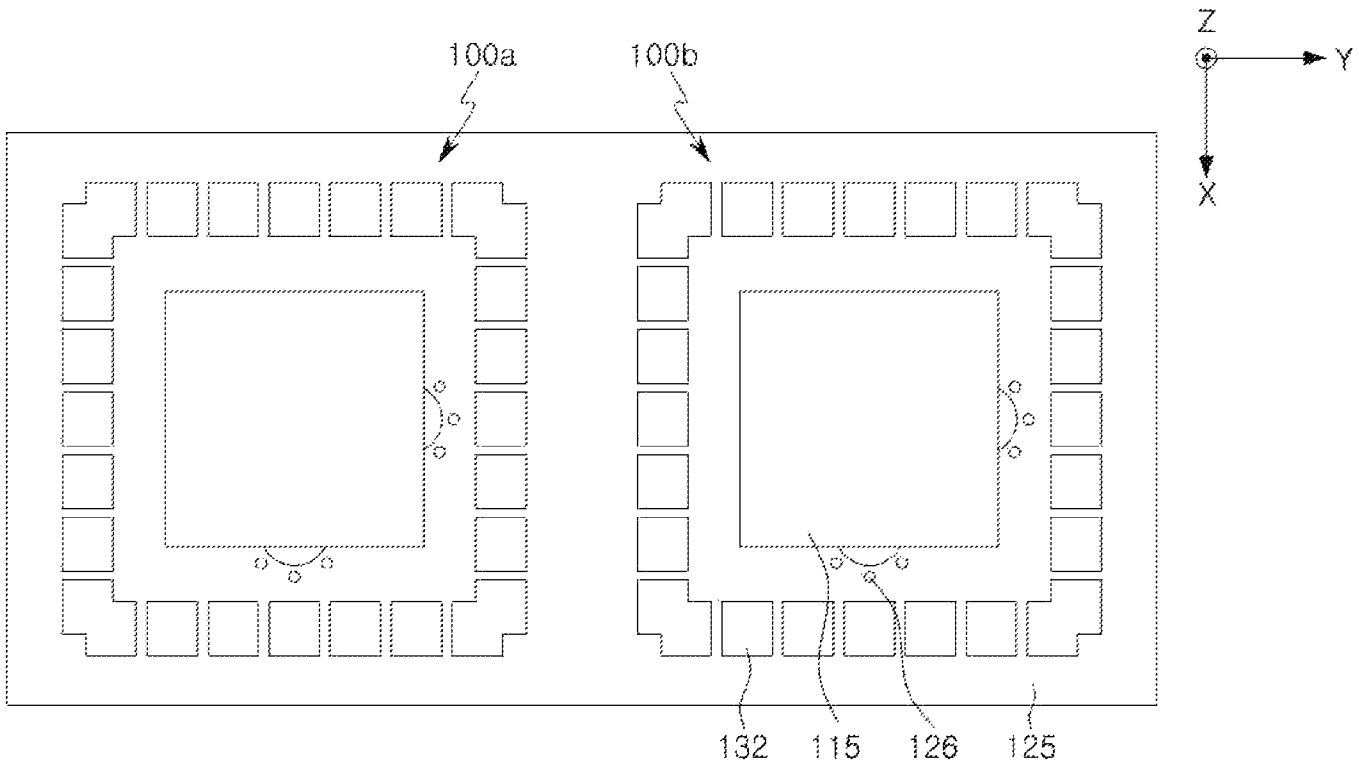
FIG. 4A is a plan view of an antenna module, according to an example.

FIG. 4A is a plan view of an antenna module 1-1, according to an example.

Referring to FIG. 4A, the chip patch antennas 100*a* and 100*b* may be disposed in a first direction, for example, an X direction. For example, the chip patch antennas 100*a* and 100*b* may be arranged in a 1×n structure. In this case, n is a natural number of 2 or more. Accordingly, the antenna module 1-1 may be efficiently disposed at the edge of an electronic device.

Depending on the design, the chip patch antennas 100*a* and 100*b* may be arranged in an m×n structure. In this case, m and n are natural numbers of 2 or more. Accordingly, the antenna module 1-1 may be disposed adjacent to a corner of an electronic device.

The upper edge coupling patterns 132 may be arranged to surround each of upper coupling patterns 115.

Figure 4B:
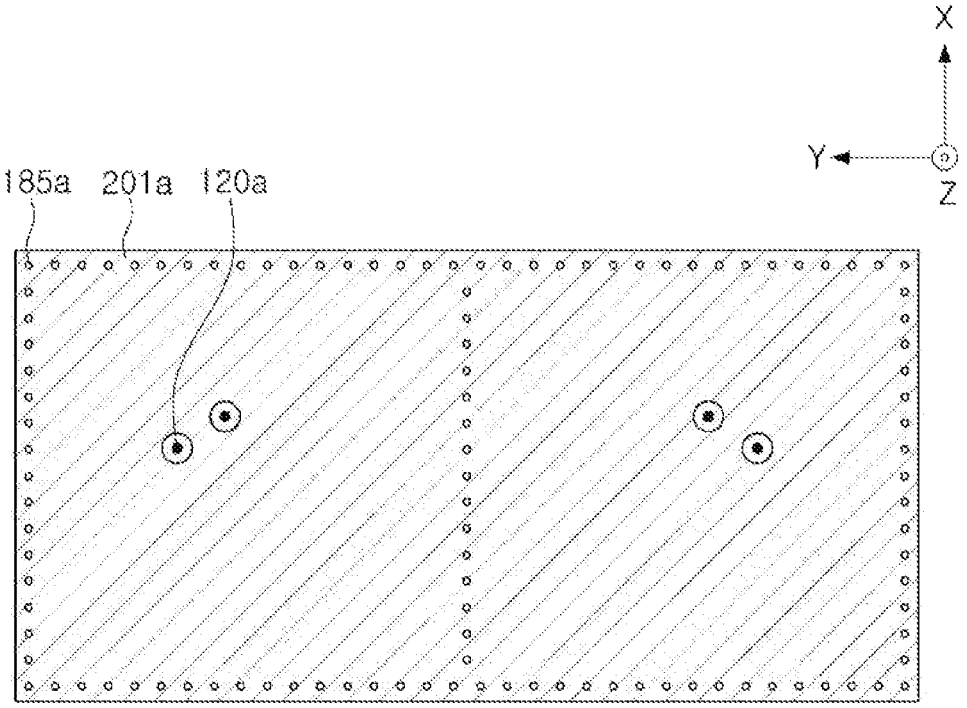
FIG. 4B is a plan view illustrating a ground plane below chip patch antennas of FIG. 4A.
Figure 4C:
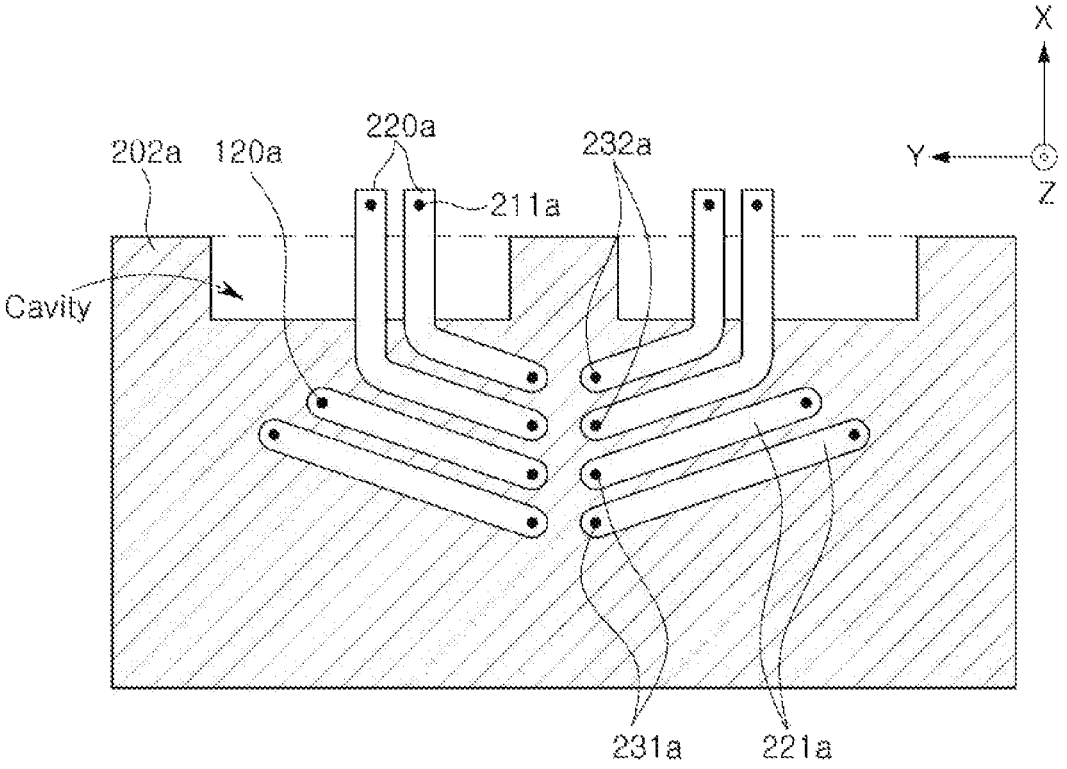
FIG. 4C is a plan view illustrating a feed line below the ground plane of FIG. 4B.
Figure 4D:
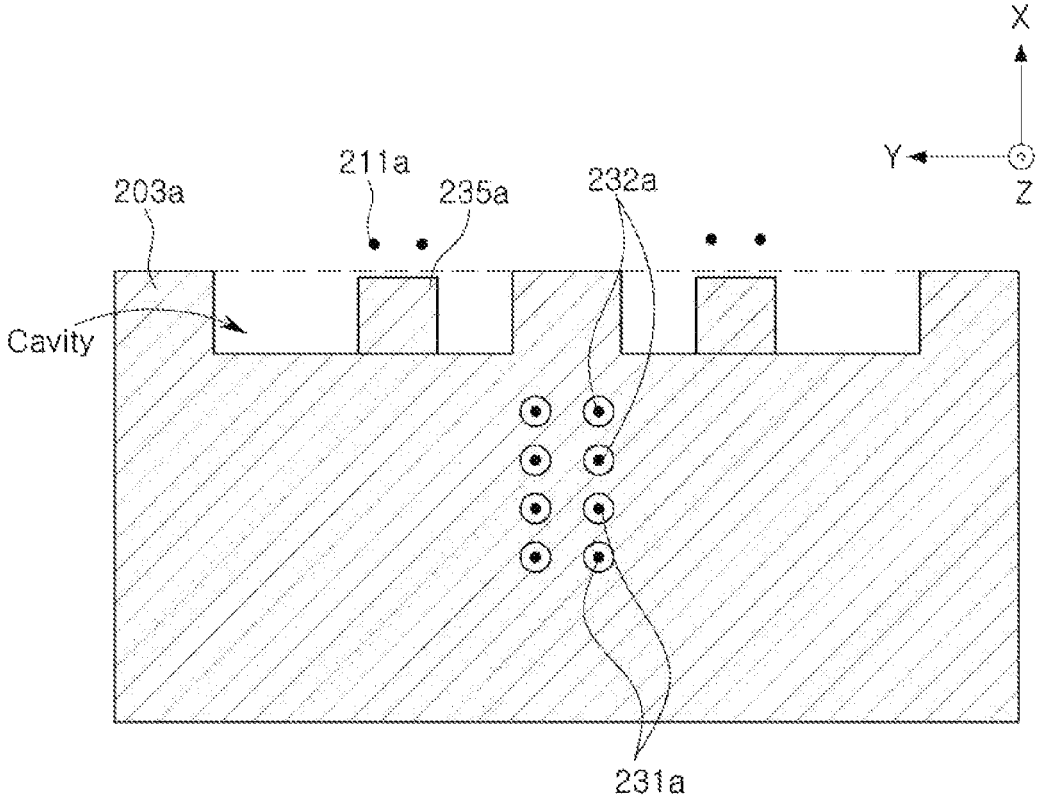
FIG. 4D is a plan view illustrating a wiring via and a second ground plane below the feed line of FIG. 4C.
Figure 4E:
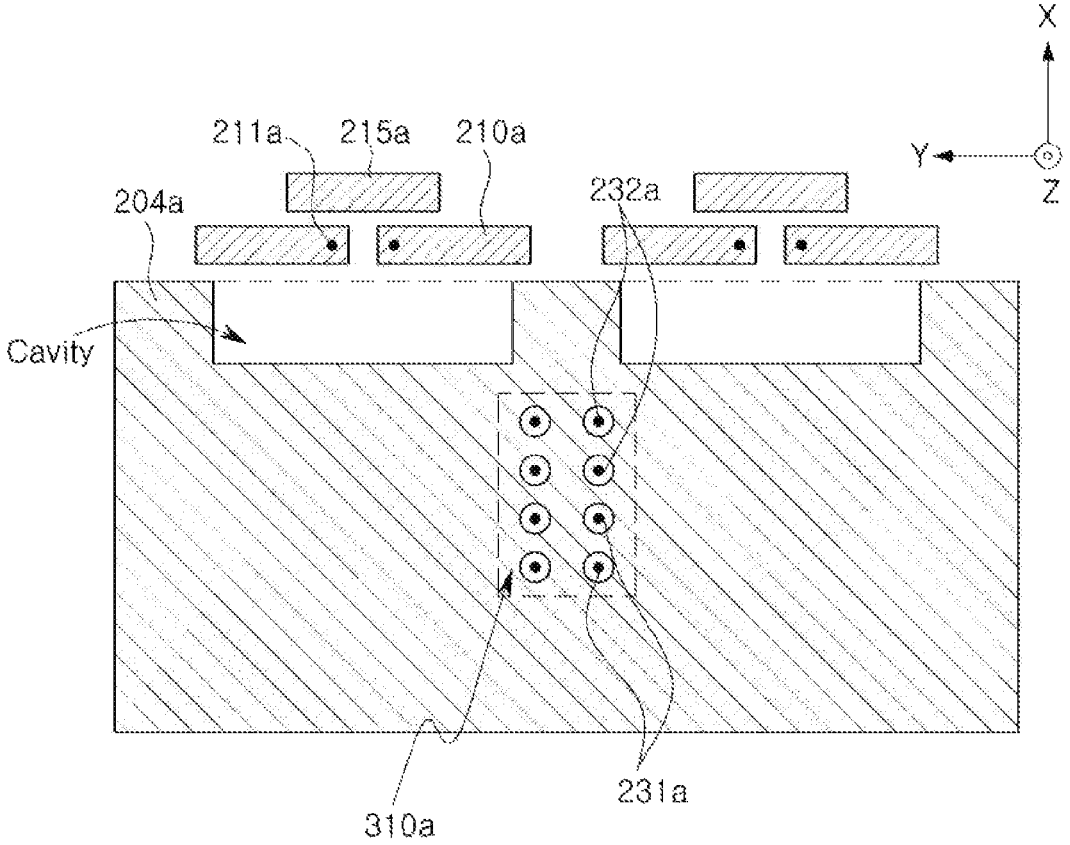
FIG. 4E is a plan view illustrating an IC placement region and an endfire antenna below the second ground plane of FIG. 4D.

FIG. 4B is a plan view illustrating a ground plane 201*a* below the chip patch antennas 100*a* and 100*b* of FIG. 4A. FIG. 4C is a plan view illustrating a feed line 221*a* below the ground plane of FIG. 4B. FIG. 4D is a plan view illustrating a wiring via 231*a* below the feed line 221*a* of FIG. 4C and a second ground plane 203*a*. FIG. 4E is a plan view illustrating an IC placement region and an endfire antenna below the second ground plane 203*a* of FIG. 4D.

Referring to FIG. 4B, the ground plane 201*a* may have a through-hole through which a feed via 120*a* passes, and may electromagnetically shield a patch antenna pattern 110*a* from a feed line. A second shielding via 185*a* may extend downwardly, for example, in a Z direction.

Referring to FIG. 4C, a wiring ground plane 202*a* may surround at least a portion of an endfire antenna feed line 220*a* and a feed line 221*a*. The endfire antenna feed line 220*a* may be electrically connected to a second wiring via 232*a*, and the feed line 221*a* may be electrically connected to a first wiring via 231*a*. The wiring ground plane 202*a* may electromagnetically shield the endfire antenna feed line 220*a* from the feed line 221*a*. One end of the endfire antenna feed line 220*a* may be connected to a second feed via 211*a*.

Referring to FIG. 4D, a second ground plane 203*a* may have through-holes through which the first wiring via 231*a* and the second wiring via 232*a* pass, respectively, and may have a coupling ground pattern 235*a*. The second ground plane 203*a* may electromagnetically shield the feed line 221*a* from the IC 310*a* (FIG. 4E).

Referring to FIG. 4E, an IC ground plane 204*a* may have through-holes through which the first wiring via 231*a* and the second wiring via 232*a* pass, respectively. The IC 310*a* may be disposed below the IC ground plane 204*a* and may be electrically connected to the first wiring via 231*a* and the second wiring via 232*a*. The endfire antenna pattern 210*a* and a director pattern 215*a* may be disposed at substantially the same height as the IC ground plane 204*a*.

The IC ground plane 204*a* may provide a ground used in a circuit of the IC 310*a* and/or a passive component to the IC 310*a* and/or the passive component. Depending on the design, the IC ground plane 204*a* may provide a transmission path of power and a signal used in the IC 310*a* and/or the passive component. Thus, the IC ground plane 204*a* may be electrically connected to the IC 310*a* and/or the passive component.

The wiring ground plane 202*a*, the second ground plane 203*a*, and the IC ground plane 204*a* may have a recessed shape to provide a cavity. Accordingly, the endfire antenna pattern 210*a* may be disposed to be relatively closer to the IC ground plane 204*a*.

On the other hand, the vertical relationships and shapes of the wiring ground plane 202*a*, the second ground plane 203*a*, and the IC ground plane 204*a* may be changed depending on the design.

Figure 5:
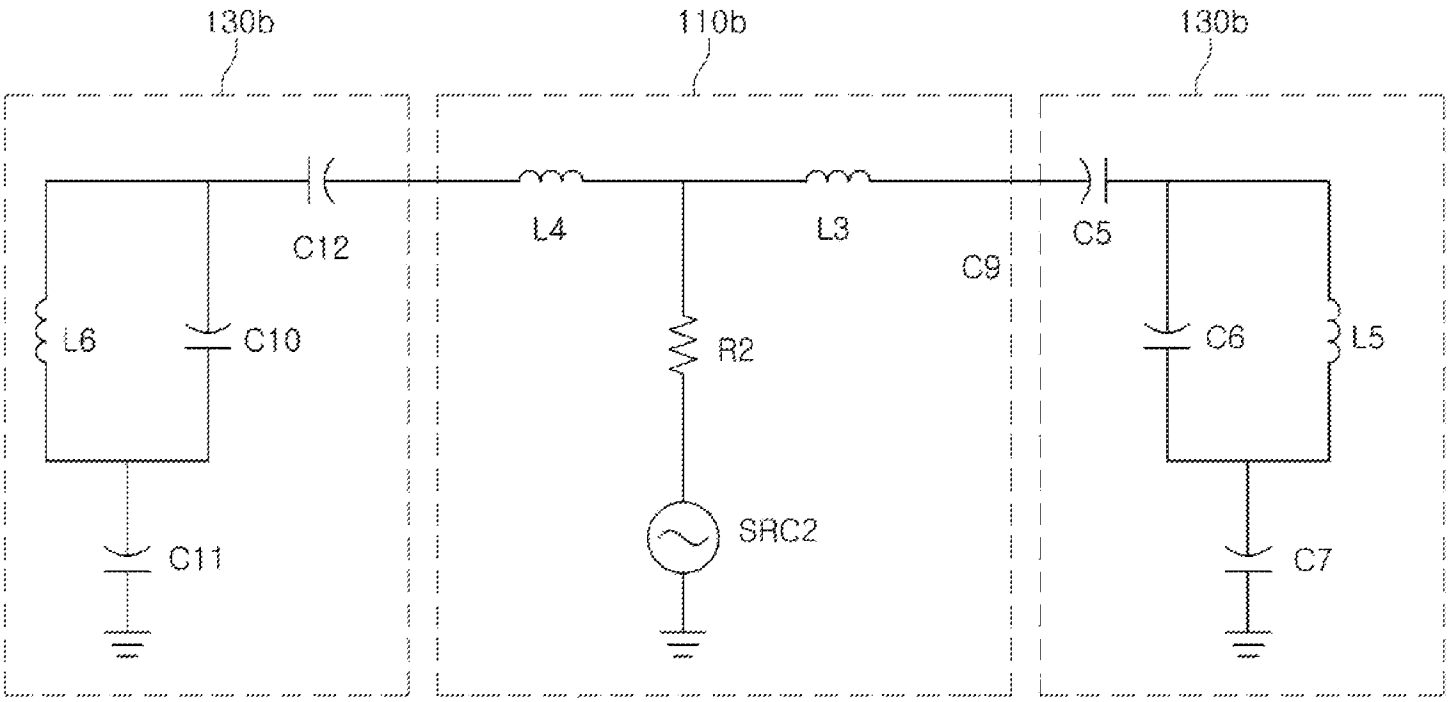
FIG. 5 is a diagram illustrating an equivalent circuit of an antenna apparatus and an antenna module, according to an example.

FIG. 5 is a diagram illustrating an equivalent circuit of an antenna apparatus and an antenna module, according to an example.

Referring to FIG. 5, a patch antenna pattern 110*b* of an antenna apparatus may transmit an RF signal to a source SRC2 such as an IC, or may receive an RF signal, and may have a resistance value R2 and inductances L3 and L4.

Upper edge coupling patterns 130*b* may have capacitances C5 and C12 with respect to the patch antenna pattern 110*b*, capacitances C6 and 010 between the upper edge coupling patterns 130*b*, inductances L5 and L6 of the upper edge coupling patterns, respectively, and capacitances C7 and 011 between the upper edge coupling patterns 130*b* and the ground plane.

The capacitance and inductance of the aforementioned edge coupling patterns may be determined on a principle similar to those of the upper edge coupling patterns 130*b*.

A frequency band and a bandwidth of the antenna apparatus may be determined by the above-described resistance value, capacitance, and inductance.

Figure 6A:
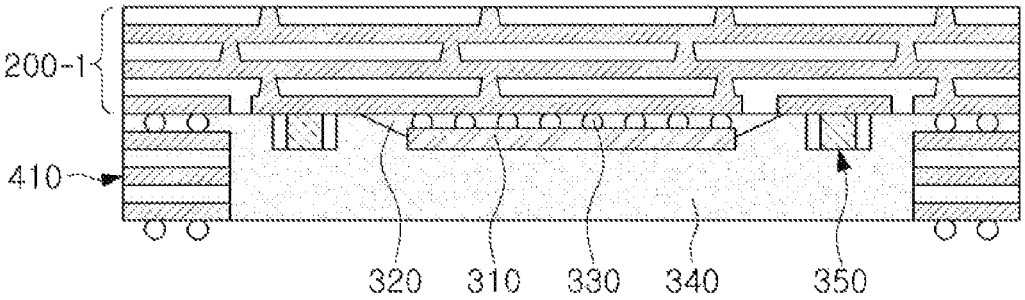
FIGS. 6A and 6B are side views illustrating a lower structure of a connection member included in an antenna apparatus and an antenna module, according to an example.
Figure 6B:
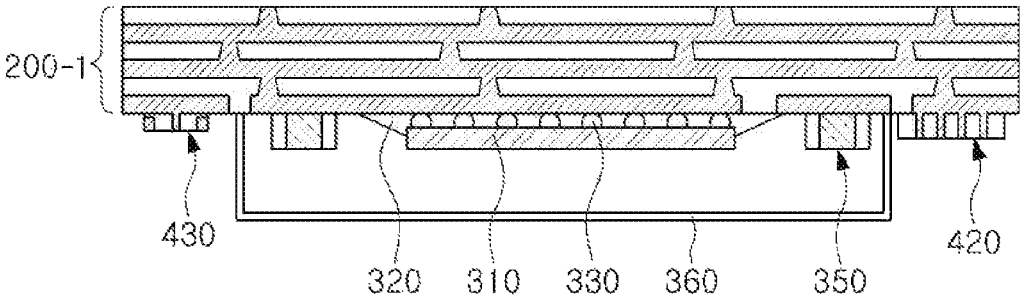

FIGS. 6A and 6B are side views illustrating a lower structure of the connection member 200 included in an antenna apparatus and an antenna module, according to an example.

Referring to FIG. 6A, an antenna apparatus and an antenna module include at least a portion of a connection member 200-1, an IC 310, an adhesive member 320, an electrical connection structure 330, an encapsulant 340, passive components 350, and the core member 410.

The connection member 200-1 may have a structure similar to that of the connection member 200 described above with reference to FIGS. 1 to 5.

The IC 310 may be the same IC as the IC 310*a* described in the foregoing example, and may be disposed below the connection member 200-1. The IC 310 may be electrically connected to the wiring of the connection member 200-1 to transmit or receive RF signals, and may be electrically connected to a ground plane of the connection member 200-1 to receive the ground. For example, the IC 310 may perform at least a portion of frequency conversion, amplification, filtering, phase control, and power generation to generate a converted signal.

The adhesive member 320 may bond the IC 310 and the connection member 200-1 to each other.

The electrical connection structure 330 may electrically connect the IC 310 and the connection member 200-1 to each other. For example, the electrical connection structure 330 may have a structure such as a solder ball, a pin, a land, or a pad. The electrical connection structure 330 has a melting point lower than that of the ground plane, with respect to the wiring of the connection member 200-1, and thus, may electrically connect the connection member 200-1 and the IC 310 to each other through a predetermined process using the lower melting point described above.

The encapsulant 340 may seal at least a portion of the IC 310 and may improve heat radiation performance and shock protection performance of the IC 310. For example, the encapsulant 340 may be implemented by a photo imageable encapsulant (PIE), Ajinomoto Build-up Film (ABF), an epoxy molding compound (EMC), or the like.

The passive component 350 may be disposed on a lower surface of the connection member 200-1, and may be electrically connected to the wiring of the connection member 200-1 and/or the ground plane through the electrical connection structure 330. For example, the passive component 350 may include at least a portion of a capacitor, for example, a multilayer ceramic capacitor (MLCC), an inductor and a chip resistor.

The core member 410 may be disposed below the connection member 200-1, and may be electrically connected to the connection member 200-1 to receive an intermediate frequency (IF) signal or a baseband signal from the outside thereof and transmit the signal to the IC 310, or to receive the IF signal or the baseband signal from the IC 310 to transmit the signal externally. In this case, a frequency of the RF signal, for example, the frequency of 24 GHz, 28 GHz, 36 GHz, 39 GHz or 60 GHz, is greater than a frequency of the IF signal, for example, the frequency of 2 GHz, 5 GHz or 10 GHz.

For example, the core member 410 may transmit or receive an IF signal or a baseband signal to or from the IC 310, through the wiring included in the IC ground plane of the connection member 200-1. Since a first ground plane of the connection member 200-1 is disposed between the IC ground plane and the wiring, the IF signal or the baseband signal may be isolated from the RF signal in the antenna apparatus and the antenna module.

Referring to FIG. 6B, the antenna apparatus and the antenna module, according to an example, may include at least a portion of a shielding member 360, a connector 420, and a chip endfire antenna 430.

The shielding member 360 may be disposed below the connection member 200-1, and may be configured together with the connection member 200-1, such that the IC 310 may be confined therebetween. For example, the shielding member 360 may be disposed to cover the IC 310 and the passive component 350 together, for example, in a conformal shielding manner, or to respectively cover the IC 310 and the passive component 350, for example, in a compartmental shielding manner. For example, the shielding member 360 may have the form of a hexahedron of which one surface is open, and may have a receiving space of the hexahedron, through coupling with the connection member 200-1. The shielding member 360 may be implemented using a material of high conductivity, such as copper, to have a relatively short skin depth, and may be electrically connected to the ground plane of the connection member 200-1. Accordingly, the shielding member 360 may reduce electromagnetic noise that the IC 310 and the passive component 350 may receive.

The connector 420 may have a connection structure of a cable such as a coaxial cable or a flexible printed circuit board (PCB), may be electrically connected to an IC ground plane of the connection member 200-1. For example, the connector 420 may receive an IF signal, a baseband signal, and/or power from a cable, or may provide an IF signal and/or a baseband signal to a cable.

The chip endfire antenna 430 may transmit or receive the RF signal in support of the antenna apparatus and the antenna module. For example, the chip endfire antenna 430 may include a dielectric block having a dielectric constant greater than that of an insulating layer, and electrodes disposed on both surfaces of the dielectric block. One of the electrodes may be electrically connected to the wiring of the connection member 200-1, and the other thereof may be electrically connected to the ground plane of the connection member 200-1.

Figure 7:
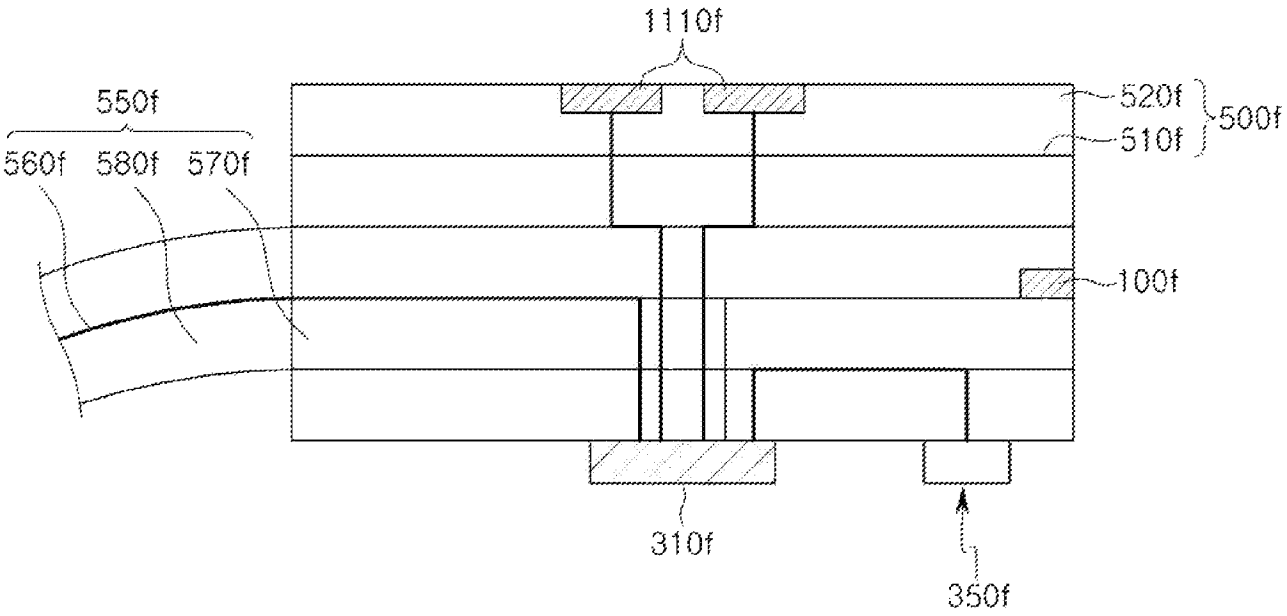
FIG. 7 is a side view illustrating the structure of an antenna apparatus and an antenna module, according to an example.

FIG. 7 is a side view illustrating the structure of an antenna apparatus and an antenna module, according to an example.

Referring to FIG. 7, the antenna apparatus and the antenna module have a structure in which an endfire antenna 100*f*, a patch antenna pattern 1110*f*, an IC 310*f*, and a passive component 350*f* are integrated with a connection member 500*f*.

The endfire antenna 100*f* and the patch antenna pattern 1110*f* may be designed in the same manner as the above-described antenna apparatus and the above-described patch antenna pattern, respectively. The endfire antenna 100*f* and the patch antenna pattern 1110*f* may receive RF signals from the IC 310*f* to transmit the received RF signals, or may transmit the received RF signals to the IC 310*f*.

The connection member 500*f* may have a structure in which at least one conductive layer 510*f* and at least one insulating layer 520*f* are laminated, for example, a structure of a printed circuit board. The conductive layer 510*f* may have a ground plane and a feed line as described above.

In addition, the antenna apparatus and the antenna module may further include a flexible connection member 550*f*. The flexible connection member 550*f* may include a first flexible region 570*f* vertically overlapping the connection member 500*f* and a second flexible region 580*f* not vertically overlapping the connection member 500*f*.

The second flexible region 580*f* may be flexibly bent in the vertical direction. Accordingly, the second flexible region 580*f* may be flexibly connected to the connector of the set substrate and/or an antenna apparatus adjacent thereto.

The flexible connection member 550*f* may include a signal line 560*f*. Intermediate frequency (IF) signals and/or baseband signals may be transmitted to the IC 310*f* via the signal line 560*f*, or transmitted to an adjacent antenna apparatus and/or a connector of the set substrate.

Figure 8A:
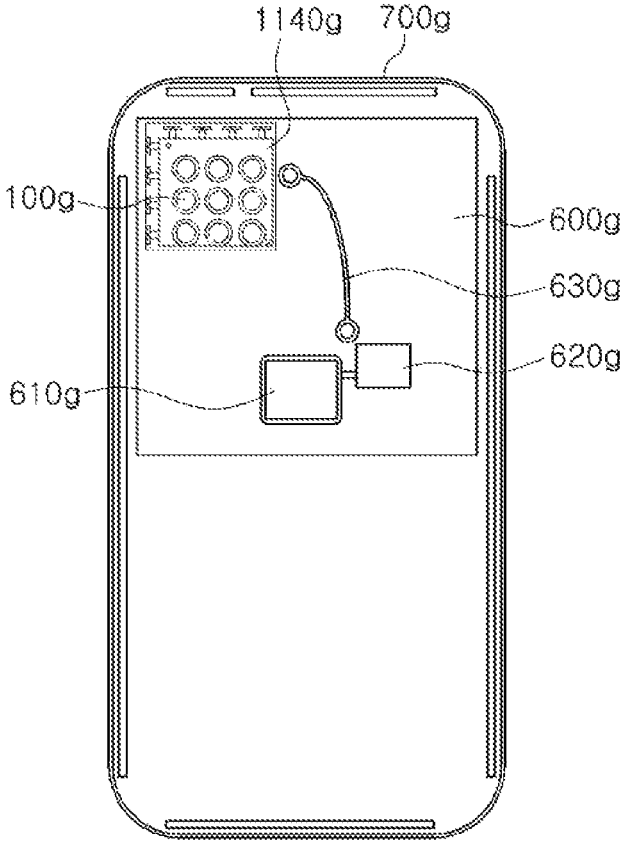
FIGS. 8A to 8C are plan views illustrating arrangements of antenna apparatuses and antenna modules in electronic devices, according to an example.
Figure 8B:
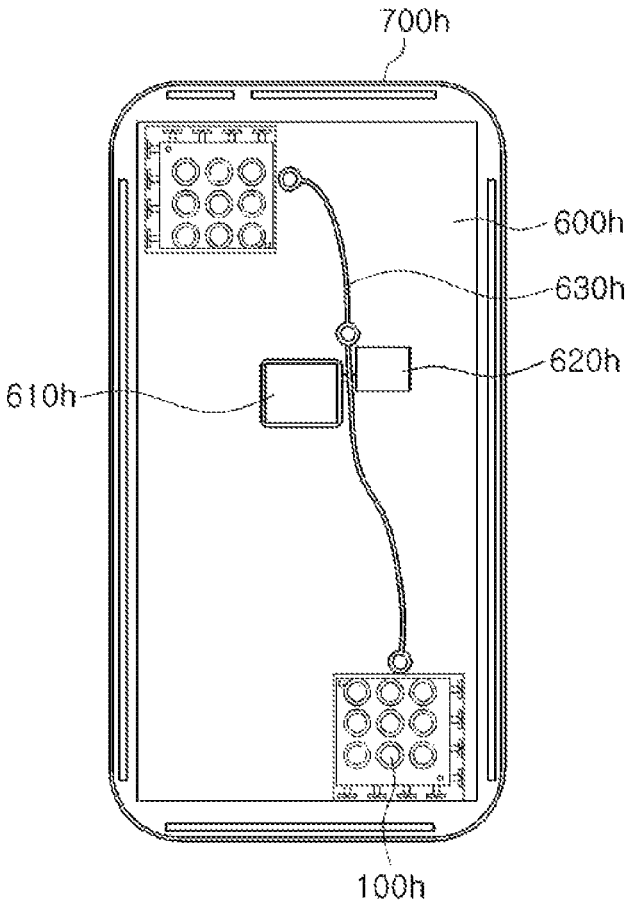
Figure 8C:
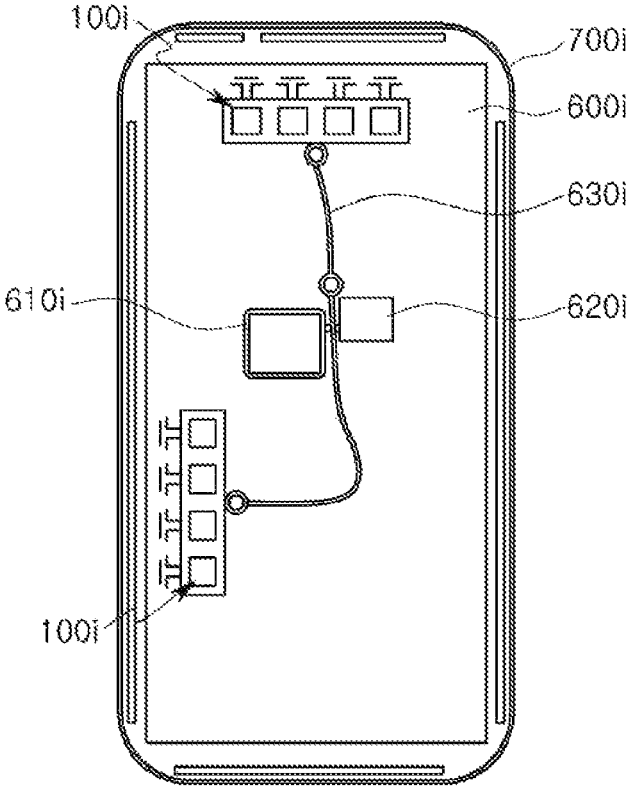

FIGS. 8A to 8C are plan views illustrating arrangements of antenna apparatuses and an antenna modules in electronic devices, according to examples.

Referring to FIG. 8A, an antenna apparatus and an antenna module including a chip patch antenna 100*g* may be disposed adjacent to a lateral boundary of an electronic device 700*g* on a set substrate 600*g* of the electronic device 700*g*.

The electronic device 700*g* may be a smartphone, a personal digital assistant, a digital video camera, a digital still camera, a network system, a computer, a monitor, a tablet PC, a laptop computer, a netbook, a television set, a video game, a smartwatch, an automobile, or the like, but is not limited to such examples.

A communications module 610*g* and a baseband circuit 620*g* may also be disposed on the set substrate 600*g*. The antenna apparatus may be electrically connected to the communications module 610*g* and/or the baseband circuit 620*g* via a coaxial cable 630*g*.

The communications module 610*g* may include at least a portion of a memory chip such as a volatile memory (for example, a dynamic random access memory (DRAM)), a nonvolatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like, to perform digital signal processing.

The baseband circuit 620*g* may perform analog-to-digital conversion, amplification for an analog signal, filtering, and frequency conversion to generate a base signal. The base signal input/output from the baseband circuit 620*g* may be transmitted to the antenna apparatus via a cable.

For example, the base signal may be transmitted to the IC through the electrical connection structure, the core via, and the wiring. The IC may convert the base signal into an RF signal in a millimeter wave (mmWave) band.

Referring to FIG. 8B, antenna apparatuses and antenna modules each including a chip patch antenna 100*h* may be disposed adjacent to one side boundary and another side boundary of an electronic device 700*h*, respectively, on the set substrate 600*h* of the electronic device 700*h*. A communications module 610*h* and a baseband circuit 620*h* may also be disposed on the set substrate 600*h*. The antenna apparatuses and antenna modules may be electrically connected to the communications module 610*h* and/or the baseband circuit 620*h* through a coaxial cable 630*h*.

Referring to FIG. 8C, antenna apparatuses and antenna modules each including a chip patch antenna 100*i* may be respectively disposed adjacent to the centers of sides of an electronic device 700*i* having a polygonal shape, on a set substrate 600*i* of an electronic device 700*i*. A communications module 610*i* and a baseband circuit 620*i* may also be disposed on the set substrate 600*i*. The antenna apparatuses and the antenna modules may be electrically connected to the communications module 610*i* and/or the baseband circuit 620*i* through a coaxial cable 630*i*.

The patch antenna pattern, the upper coupling pattern, the edge coupling pattern, the upper edge coupling pattern, the feed via, the shielding via, the wiring via, the feed line, the ground plane, the endfire antenna pattern, the director pattern, the coupling ground pattern, and the electrical connection structure described herein may include a metal material, such as copper (Cu), aluminum (Al), silver (Ag), tin (Sn), gold (Au), nickel (Ni), lead (Pb), titanium (Ti), or a conductive material such as alloys of Cu, Al, Ag, Sn, Au, Ni, Pb, and Ti, and may be formed by a plating method, such as chemical vapor deposition (CVD), physical vapor deposition (PVD), sputtering, a subtractive process, an additive process, a semi-additive process (SAP), a modified semi-additive process (MSAP), or the like. However, the disclosure is not limited to these examples.

The insulating layer and the dielectric layer described herein may also be implemented by FR4, Liquid Crystal Polymer (LCP), Low Temperature Co-fired Ceramic (LTCC), a thermosetting resin such as epoxy resin, a thermoplastic resin such as polyimide, or a resin formed by impregnating these resins in a core material such as a glass fiber, a glass cloth, a glass fabric, or the like, together with an inorganic filler, a prepreg material, Ajinomoto Build-up Film (ABF), Bismaleimide Triazine (BT) resin, a photoimageable dielectric (PID) resin, a copper clad laminate (CCL), an insulating material of glass or ceramic series, or the like. The insulating layer and the dielectric layer may fill at least a portion of an antenna apparatus as disclosed herein, in which a patch antenna pattern, an upper coupling pattern, an edge coupling pattern, an upper edge coupling pattern, a feed via, a shielding via, a wiring via, a feed line, a ground plane, an endfire antenna pattern, a director pattern, a coupling ground pattern, and an electrical connection structure are not disposed.

The RF signals described herein may be used in various communications protocols such as Wi-Fi (IEEE 802.11 family or the like), WiMAX (IEEE 802.16 family or the like), IEEE 802.20, Long Term Evolution (LTE), Ev-DO, HSPA+, HSDPA+, HSUPA+, EDGE, GSM, GPS, GPRS, CDMA, TDMA, DECT, Bluetooth, 3rd Generation (3G), 4G, 5G and various wireless and wired protocols designated thereafter, but the disclosure is not limited to these examples.

As set forth above, in the case of an antenna apparatus, an antenna module, and a chip patch antenna disposed therein, according to an example, antenna performance related to a bandwidth, a gain, directivity, an antenna size, or the like, may be improved without substantially degrading the size and energy efficiency in terms of electrical connection.

The communication modules 610*g*, 610*h*, and 610*i* in FIGS. 8A, 8B, and 8C that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a ground plane having a through-hole;

a feed line disposed below the ground plane;

an insulating layer disposed between the feed line and the ground plane;

a feed via having a first end electrically connected to the feed line, and passing through the through-hole; and a chip patch antenna electrically connected to a second end of the feed via, and comprising a patch antenna pattern electrically connected to the feed via, an upper coupling pattern disposed above the patch antenna pattern, edge coupling patterns surrounding a portion of the patch antenna pattern, upper edge coupling patterns surrounding a portion of the upper coupling pattern, and a dielectric layer disposed in a first region between the patch antenna pattern and the upper coupling pattern, and in a second region between the edge coupling patterns and the upper edge coupling patterns, and having a dielectric constant higher than a dielectric constant of the insulating layer.

2. The antenna apparatus of claim 1, further comprising an electrical connection structure electrically connected to the feed via in series on the ground plane, and having a melting point lower than a melting point of the feed via.

3. The antenna apparatus of claim 1, wherein a portion of the dielectric layer corresponding to the first region and a portion of the dielectric layer corresponding to the second region are integrated with each other, and wherein the dielectric layer has a thickness corresponding to a distance between the patch antenna pattern and the upper coupling pattern.

4. The antenna apparatus of claim 1, wherein the patch antenna pattern, the upper coupling pattern, the edge coupling patterns, and the upper edge coupling patterns are separated from each other.

5. The antenna apparatus of claim 4, wherein the patch antenna pattern and the edge coupling patterns are disposed on a same layer, and wherein the upper coupling pattern and the upper edge coupling patterns are disposed on another same layer.

6. The antenna apparatus of claim 5, wherein each of the edge coupling patterns is smaller than the patch antenna pattern, and wherein each of the edge coupling patterns is smaller than the upper coupling pattern.

7. The antenna apparatus of claim 5, wherein a distance between adjacent edge coupling patterns, among the edge coupling patterns, is less than a distance between each of the edge coupling patterns and the patch antenna pattern, and wherein a distance between adjacent upper edge coupling patterns, among the upper edge coupling patterns, is less than a distance between each of the upper edge coupling patterns and the upper coupling pattern.

8. The antenna apparatus of claim 1, wherein the edge coupling patterns are arranged to form a polygon, wherein an outer boundary of an edge coupling pattern, among the edge coupling patterns, closest to a vertex of the polygon includes a groove.

9. The antenna apparatus of claim 1, wherein portions of the patch antenna pattern on two sides of a point of the patch antenna pattern at which the feed via is connected to the feed via are recessed, and wherein a width of each of the recessed portions of the patch antenna pattern is greater than a distance between the recessed portions of the patch antenna pattern.

10. The antenna apparatus of claim 1, wherein a thickness of the dielectric layer is greater than a thickness of the insulating layer.

11. The antenna apparatus of claim 10, wherein the dielectric layer is disposed to isolate the patch antenna pattern from the upper coupling pattern and to isolate the edge coupling patterns from the upper edge coupling patterns.

12. The antenna apparatus of claim 11, wherein an area between the edge coupling patterns and the ground plane is formed of a non-conductive material or air.

13. The antenna apparatus of claim 11, further comprising an encapsulant disposed on an upper side of the upper edge coupling patterns and an upper side of the upper coupling pattern, and wherein an area between the upper edge coupling patterns and the encapsulant, and an area between the upper coupling pattern and the encapsulant do not include a conductive layer.

14. An antenna module, comprising:

a ground plane having through-holes;

feed lines disposed below the ground plane;

an insulating layer disposed between the feed lines and the ground plane;

feed vias each having a first end electrically connected to a corresponding feed line among the feed lines, and passing through a corresponding through-hole among the through-holes; and chip patch antennas electrically connected, respectively, to second ends of corresponding feed vias among the feed vias, wherein at least one chip patch antenna among the chip patch antennas comprises a patch antenna pattern electrically connected to a corresponding feed via among the corresponding feed vias;

an upper coupling pattern disposed above the patch antenna pattern;

edge coupling patterns surrounding the patch antenna pattern;

upper edge coupling patterns surrounding the upper coupling pattern; and a dielectric layer disposed in a first region between the patch antenna pattern and the upper coupling pattern, and in a second region between the edge coupling patterns and the upper edge coupling patterns, and having a dielectric constant higher than a dielectric constant of the insulating layer.

15. The antenna module of claim 14, wherein the dielectric layer is disposed to isolate the patch antenna pattern from the upper coupling pattern and to isolate the edge coupling patterns from the upper edge coupling patterns.

16. The antenna module of claim 14, further comprising electrical connection structures electrically connected, respectively, to the feed vias on the ground plane, and having a melting point lower than a melting point of the feed vias.

17. The antenna module of claim 14, further comprising:

an integrated circuit (IC) disposed below the feed lines;

wiring vias electrically connecting the feed lines and the IC to each other, respectively; and a core member isolated from the feed lines and including a core via electrically connected to the IC, and surrounding the IC.

18. A chip patch antenna, comprising:

a feed port;

a second dielectric layer disposed on the feed port;

a feed via penetrating through the second dielectric layer and having a first end electrically connected to the feed port;

a patch antenna pattern disposed on the second dielectric layer and electrically connected to a second end of the feed via;

an upper coupling pattern disposed above the patch antenna pattern;

edge coupling patterns surrounding at least a portion of the patch antenna pattern;

upper edge coupling patterns surrounding at least a portion of the upper coupling pattern; and a first dielectric layer disposed in a first region between the patch antenna pattern and the upper coupling pattern and in a second region between the edge coupling patterns and the plurality of upper edge coupling patterns, and having a dielectric constant equal to or greater than claim 5.

19. The chip patch antenna of claim 18, wherein the dielectric constant of the first dielectric layer is greater than a dielectric constant of the second dielectric layer.

20. The chip patch antenna of claim 18, wherein the patch antenna pattern, the upper coupling pattern, the edge coupling patterns, and the upper edge coupling patterns are separated from each other.

21. The chip patch antenna of claim 20, wherein each of the edge coupling patterns is smaller than the patch antenna pattern, wherein each of the upper edge coupling patterns is smaller than the upper coupling pattern, wherein a distance between adjacent edge coupling patterns, among the edge coupling patterns, is less than a distance between each of the edge coupling patterns and the patch antenna pattern, and wherein a distance between adjacent edge coupling patterns, among the upper edge coupling patterns, is less than a distance between each of the upper edge coupling patterns and the upper coupling pattern.

22. The chip patch antenna of claim 18, wherein portions of the patch antenna pattern on two sides of a point of the patch antenna pattern at which the feed via is connected to the feed via are recessed, and wherein a width of each of the recessed portions of the patch antenna pattern is greater than a distance between the recessed portions of the patch antenna pattern.

23. The chip patch antenna of claim 18, wherein the edge coupling patterns are arranged to form a polygon, and wherein an outer boundary of an edge coupling pattern, among the edge coupling patterns, closest to a vertex of the polygon includes a groove.

24. The chip antenna of claim 18, wherein the edge coupling patterns are disposed around the coupling pattern in a polygonal path, and wherein a groove is formed in a corner region of an edge coupling pattern, among the edge coupling patterns, closest to a vertex of the polygonal path.

25. The chip antenna of claim 18, wherein the upper edge coupling patterns are disposed around the upper coupling pattern in a circular path.

26. The chip antenna of claim 25, wherein the upper coupling pattern has a circular shape.

27. The chip antenna of claim 18, wherein the patch antenna pattern and the edge coupling patterns are disposed at a first vertical position, and wherein the upper coupling pattern and the upper edge coupling patterns are disposed at a second vertical position above the first vertical position.

* * * * *